US009227210B2

(12) United States Patent
Chang

(10) Patent No.: US 9,227,210 B2
(45) **Date of Patent: *Jan. 5, 2016**

(54) CAP OF SPRAY MINERAL WATER BOTTLE AND MULTIFUNCTIONAL SPRAY MINERAL WATER BOTTLE

(75) Inventor: Chang Ho Chang, Taoyuan (TW)

(73) Assignee: Sun Solutions LTD., Guangdong (CN)

( * ) Notice: Subject to any disclaimer, the term of this patent is extended or adjusted under 35 U.S.C. 154(b) by 1029 days.

This patent is subject to a terminal disclaimer.

(21) Appl. No.: 12/912,426

(22) Filed: Oct. 26, 2010

(65) Prior Publication Data

US 2011/0180627 A1 Jul. 28, 2011

Related U.S. Application Data

(63) Continuation-in-part of application No. 12/696,047, filed on Jan. 28, 2010, now abandoned, and a continuation-in-part of application No. 12/757,202, filed on Apr. 9, 2010, now Pat. No. 8,662,419.

(30) Foreign Application Priority Data

Oct. 19, 2010 (CN) ..... 2010 1 0510654

(51) Int. Cl.

| | |
|---|---|
| ***B65D 1/32*** | (2006.01) |
| ***B05B 11/00*** | (2006.01) |
| ***B65D 47/26*** | (2006.01) |
| ***B65D 47/30*** | (2006.01) |
| ***B05B 1/02*** | (2006.01) |

(52) U.S. Cl.

CPC ..... *B05B 11/0032* (2013.01); *B05B 1/02* (2013.01); *B05B 11/0089* (2013.01); *B65D 47/263* (2013.01); *B65D 47/305* (2013.01)

(58) Field of Classification Search

CPC ..... B65D 47/305; B65D 47/263; B65D 2547/063; B65D 1/32

USPC ..... 239/437, 581.1, 463, 468, 469, 239/471–473, 487, 488, 490; 222/153.11, 222/548

See application file for complete search history.

(56) References Cited

U.S. PATENT DOCUMENTS

| | | | | |
|---|---|---|---|---|
| 6,354,320 | B1 * | 3/2002 | Kolacz et al. | 137/38 |
| 6,513,684 | B1 * | 2/2003 | Bougamont et al. | 222/548 |
| 6,722,585 | B1 * | 4/2004 | Stradella | 239/533.13 |
| 7,080,761 | B1 * | 7/2006 | Yu | 222/633 |
| 7,938,342 | B2 * | 5/2011 | Octeau et al. | 239/476 |
| 2006/0249476 | A1 * | 11/2006 | Albers et al. | 215/307 |

* cited by examiner

*Primary Examiner* — Jason Boeckmann

(74) *Attorney, Agent, or Firm* — Garcia-Zamor IP Law; Ruy M. Garcia-Zamor

(57) ABSTRACT

The invention discloses a cap of spray mineral water bottle, including cap body, spray means and water locking means. This cap of spray mineral water is used with resilient mineral water bottle body to form a multifunctional spray mineral water bottle, which can ensure normal drinking of mineral water as well as carry out spray drinking of water by means of squeezing the bottle body to transform bottle body and increase the pressure inside the bottle, thus making water to enter inlet from the outlet of water locking means on the cap, and to enter the atomizing channel through the water channel, finally to be sprayed from the spray aperture. Furthermore, in the open air or in the dusty and hot environment, you can place the mineral water bottle upside down, put the nozzle to face your body or surrounding, and squeeze the bottle body to spray, thus reducing surrounding temperature, as well as subsiding dust by combining dust and spray to make you feel cool, fresh and comfortable.

8 Claims, 10 Drawing Sheets

CAP OF SPRAY MINERAL WATER BOTTLE AND MULTIFUNCTIONAL SPRAY MINERAL WATER BOTTLE

CROSS REFERENCE TO RELATED APPLICATIONS

This application is a continuation in part of and claims benefit of and priority to the following patent properties: (1) U.S. patent application Ser. No. 12/696,047, filed on Jan. 28, 2010, (2)) U.S. patent application Ser. No. 12/757,202, filed on Apr. 9, 2010, and (3) Chinese Patent Application CN 201010510654.0, filed on Oct. 19, 2010; each of the above listed applications is hereby incorporated by reference herein as if set forth in its entirety.

TECHNICAL FIELD

The present invention relates to a cap of mineral water bottle, particularly to a cap of spray mineral water bottle, and multifunctional mineral water bottle comprised by the cap.

BACKGROUND ART

The common cap of mineral water bottle includes the cap body which is screwed with the mineral water bottleneck, and the cap body is matched with mineral water bottleneck by means of liquid-tight fit. When you want to drink the mineral water in the bottle, you remove the cap and directly drink the water. This type of cap is used for sealing the mineral water inside the bottle body, and anti-fake function as well. This type of cap has simple functions so that the mineral water bottle matched with the cap has simple functions as well, which cannot satisfy the demands of daily life of people.

Presently the mineral water, which is taken outside the home, is mainly used for drinking. When it is extremely hot or when you watch football in a stadium in the summer heat, you may want to spray the mineral water directly to your face or head to reduce temperature. However, if pouring mineral water, you may waste too much water and it cannot satisfy your demands due to insufficient water. In addition, temperature reduction effect is limited by this type of method and surrounding air cannot be improved if it is dusty. Therefore the conventional cap needs to be modified and perfected.

SUMMARY OF THE INVENTION

A main object of the present invention is to improve the existing cap, to provide a cap of spray mineral water bottle with simple structure and spray function. This cap of spray mineral water is used with resilient bottle body, so that you can drink water directly or use the water to adjust the surrounding air.

Another object of the present invention is to provide multifunctional spray mineral water bottle comprised by this cap.

To achieve the said objects, the following technical embodiments are adopted in this utility model:

A cap of spray mineral water bottle, including:

A cap body, the cap body and bottleneck are connected by means of liquid-tight fit, and an outlet aperture is disposed on the end face of the cap body;

A spray means, including an atomizing spool and nozzle, and two water channels are disposed on the outer wall of the atomizing spool, and atomizing channels corresponding to the water channels are disposed on the end face of atomizing spool corresponding to water channels; a cavity is disposed in the nozzle to hold the atomizing spool, and a spray aperture is on the end face of the nozzle; interference fit is fulfilled between the atomizing spool and nozzle cavity, and the atomizing aperture and nozzle are fit and fed through;

A water locking means, including a fixing part and a movable part which rotates relative to the fixing part, and the fixing part is fixed and connected to the cap body and an outlet is disposed; an inlet is disposed on the movable part corresponding to the outlet of fixing part; the movable part rotates relative to the fixing part back and forth to fulfill the butt joint or interleaving between the outlet of fixing part and the inlet of movable part, thus achieving the opening or closing of the spray means; a cavity is disposed in the movable part, and interference fit is fulfilled between the spray means and the cavity.

A multifunctional spray mineral water bottle, including resilient bottle body and cap of spray mineral water, whose cap includes:

A cap body, the cap body and bottleneck are connected by means of liquid-tight fit, and an outlet aperture is disposed on the end face of the cap body;

A spray means, including an atomizing spool and nozzle, and two water channels are disposed on the outer wall of the atomizing spool, and atomizing channels corresponding to the water channels are disposed on the end face of atomizing spool corresponding to water channels; a cavity is disposed in the nozzle to hold the atomizing spool, and a spray aperture is on the end face of the nozzle; interference fit is fulfilled between the atomizing spool and nozzle cavity, and the atomizing aperture and nozzle are fit and fed through;

A water locking means, including a fixing part and a movable part which rotates relative to the fixing part, and the fixing part is fixed and connected to the cap body and an outlet is disposed; an inlet is disposed on the movable part corresponding to the outlet of fixing part; the movable part rotates relative to the fixing part back and forth to fulfill the butt joint or interleaving between the outlet of fixing part and the inlet of movable part, thus achieving the opening or closing of the spray means; a cavity is disposed in the movable part, and interference fit is fulfilled between the spray means and the cavity.

The said fixing part of water locking means is a tube located axially in the center of cap body, and this tube bottom is closed and an outlet is disposed in the sidewall of the tube adjacent to the bottom; the said movable part bottom of water locking means is connected to the tube by means of liquid-tight sleeve joint and rotates relative to the tube, and an inlet is disposed in the movable part bottom corresponding to the outlet of fixing part; the movable part rotates relative to the fixing part to fulfill the butt joint or interleaving between the outlet and inlet, thus achieving the opening or closing of the spray means.

An annular groove is disposed on the inner wall of the tube of the said fixing part of water locking means, and an annular protuberance is disposed in the said movable part of water locking means matching with the groove on the inner wall of the fixing part tube.

A cylindric protuberance is disposed in the interior of the end face of the said fixing part bottom of water locking means, and this cylindric protuberance is matched with the inside diameter of movable part bottom of water locking means.

The said movable part of water locking means is straight line shape, matched with and disposed in the tube of the fixing part and it rotates relative to the tube; the spray means is disposed in the cavity in the upper end of movable part by means of interference fit.

The said movable part of water locking means is right angle shape, including the connected tubes, one in vertical direction and the other in horizontal direction, and the tube in vertical direction and tube in horizontal direction are molded into one unit; the tube in vertical direction is connected to the fixing part of water locking means by means of liquid-tight fit, the movable part rotates relative to the fixing part pursuant to the tube in vertical direction as axis; a cavity is disposed inside the tube in horizontal direction, and the spray means is disposed in the cavity and connected with the cavity by means of interference and liquid-tight fit.

A rotating handle is disposed on exterior of the upper end of the said movable part of water locking means, on-off position means is disposed between the middle and the end face of cap body, and the position means includes position blocks respectively fixed on the 0° and 90° positions of end face of cap body and a limiting stopper fixed on the corresponding position of movable part.

On-off position means of water locking means is disposed on the said end face of cap body, and this position means includes position blocks respectively fixed on 0° and 90° positions of end face of cap body, respectively positioning opening and closing of water locking means, and cambered surfaces are disposed on the position blocks in the rotating direction of the tube in the vertical direction to match with the tube.

A limiting protuberance is disposed on the cambered surface bottom of the closed position block of the said position water locking means corresponding to the other side of the tube in horizontal direction, to prevent the tube from automatically opening without external force.

The said fixing part of water locking means is fixed on the end face of cap body, spherical working face is disposed on the fixing part, wherein an outlet is disposed; the said movable part of water locking means includes a sphere which is matched with the spherical working face on the fixing part by means of liquid-tight fit, and flexibly connected to the fixing part by means of the rotating axis; a strip inlet is disposed in the outlet rotating track of the sphere, and when the sphere leaves the closing status of water locking means, the butt joint between the outlet and inlet is opened; the tube is fixed on the sphere, the tube cavity is connected to the strip inlet, and open-end of the tube is connected to the spray means by means of interference and liquid-tight fit.

A position means for opening and closing of the movable part is disposed in the said fixing part of water locking means, which allows the movable part to rotate within the specified radian of 90° degrees.

This cap of spray mineral water is used with resilient mineral water bottle body to form a multifunctional spray mineral water bottle, which can ensure normal drinking of mineral water as well as carry out spray drinking of water by means of squeezing the bottle body to transform bottle body and increase the pressure inside, thus making water to enter inlet from the outlet of water locking means on the cap, and to enter the atomizing channel through the water channel, finally to be sprayed from the spray aperture. Furthermore, in the open air or in the dusty and hot environment, you can place the mineral water bottle upside down, put the nozzle to face your body or surrounding, and squeeze the bottle body to spray, thus reducing surrounding temperature, as well as subsiding dust by combining dust and spray to make you feel cool, fresh and comfortable. This invention features in simple structure and strong practicability, so it has promising market prospect.

DETAILED DESCRIPTION OF THE PREFERRED EMBODIMENT

Figure 1:
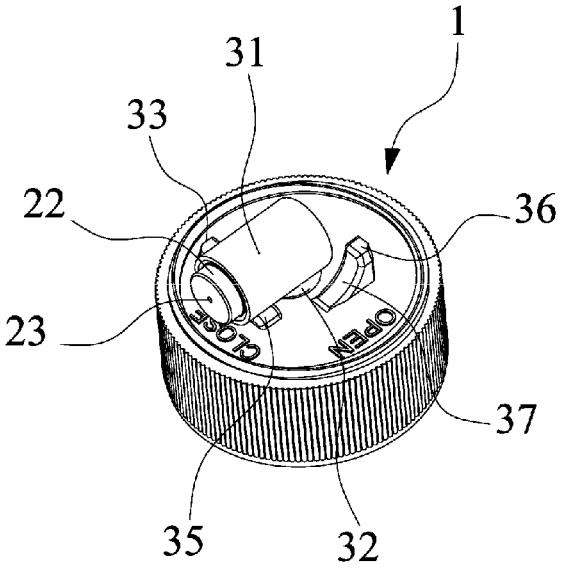
FIG. 1 is the structural schematic view for the cap of spray mineral water bottle of this invention.
Figure 2:
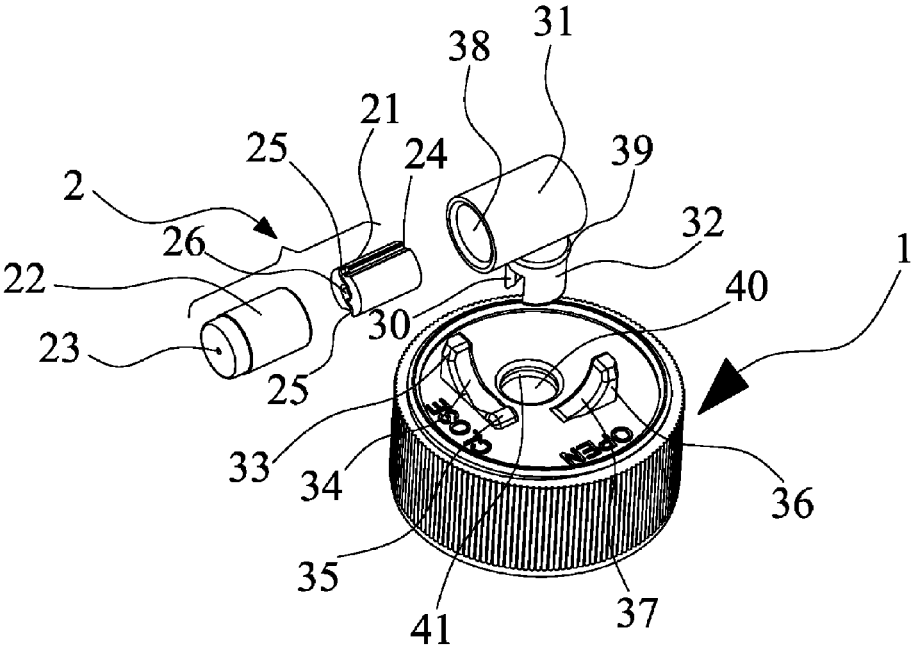
FIG. 2 is the exploded view of FIG. 1.
Figure 3:
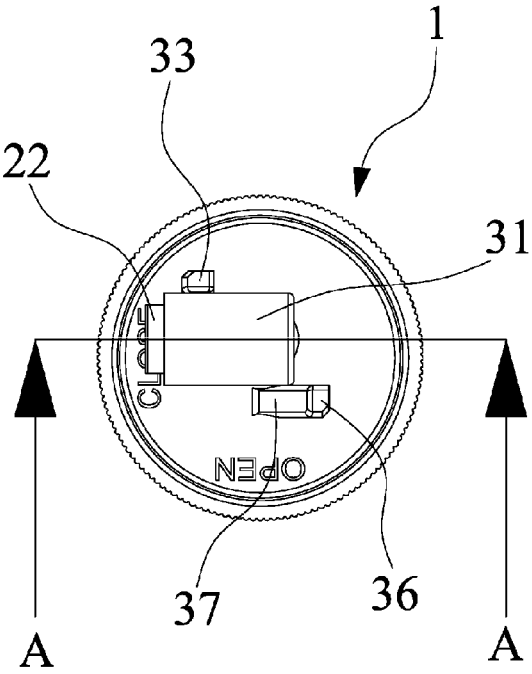
FIG. 3 is the top view of water locking means in opening status in FIG. 1.
Figure 4:
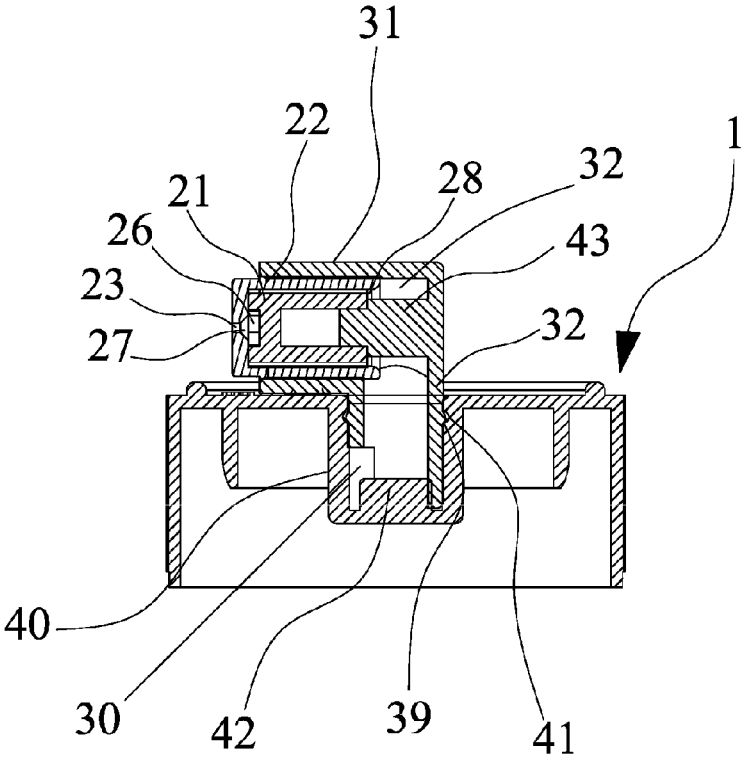
FIG. 4 is the A-A sectional view of FIG. 3.
Figure 5:
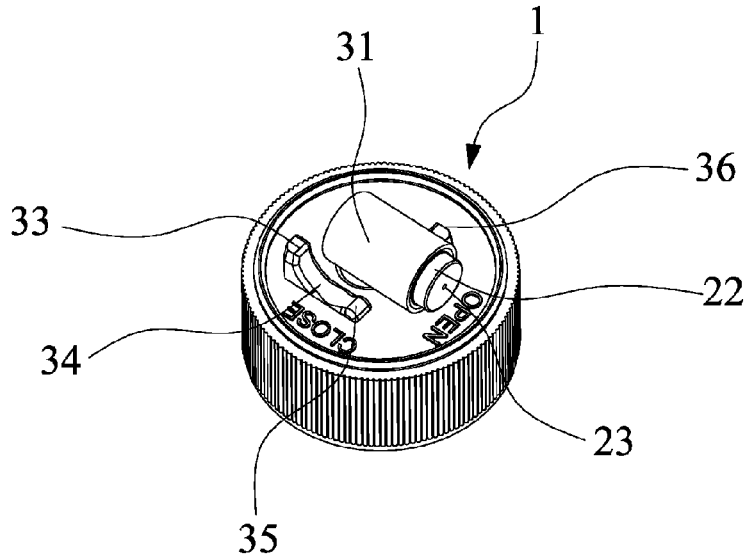
FIG. 5 is the schematic view for water locking means in closing status.
Figure 6:
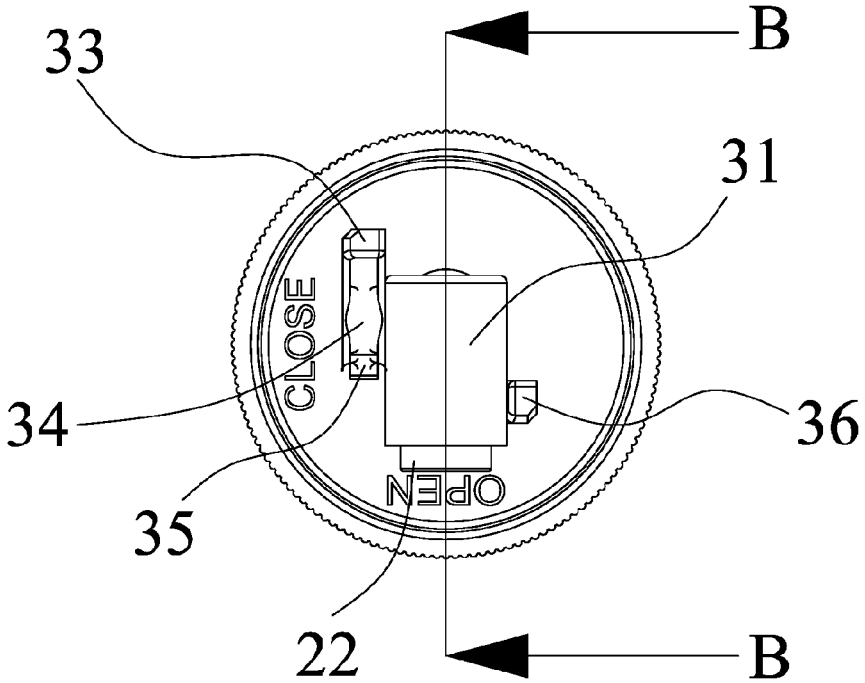
FIG. 6 is the top view of FIG. 5.
Figure 7:
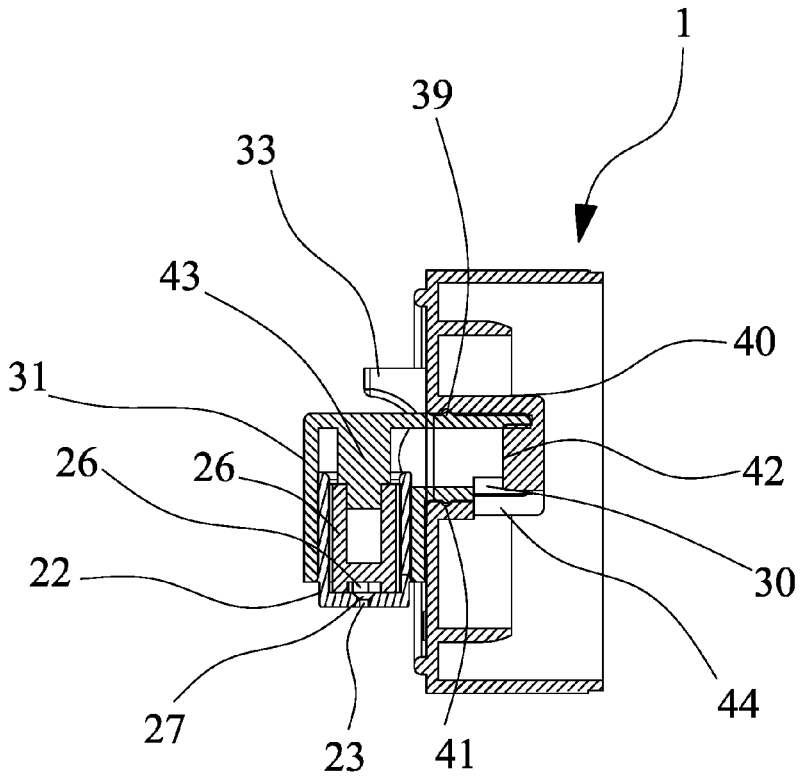
FIG. 7 is the B-B sectional view of FIG. 6.

The present invention will now be described by referring to the accompanying drawings that illustrate the preferred embodiments of the invention, from which its objects and features will be evident.

Embodiment 1

As shown in FIG. 1 to FIG. 7, a cap of spray mineral water bottle, including cap body 1, spray means 2 and water locking means. The cap body 1 and mineral water bottleneck are connected by means of liquid-tight fit, and an outlet is disposed on the end face of cap body 1. A cap body is matched with mineral water bottleneck by means of liquid-tight fit, and an outlet aperture is disposed on the end face of cap body. The spray means 2 includes atomizing spool 21 and nozzle 22, and two water channels 24 are disposed on the outer wall of atomizing spool 21, and the number of water channels can be increased pursuant to the water volume; atomizing channel 26 corresponding to water channel 24 is disposed on the end face of atomizing spool 21 corresponding to the water channel 24, and water channel 24 and atomizing channel 26 are connected by means of two connecting channels 25. Cavity 28 is disposed in nozzle 22 to hold atomizing spool 21, and spray aperture 23 is disposed on the end face of one end of nozzle 21; atomizing spool 21 is matched with the cavity of nozzle 22 by means of interference fit, and atomizing aperture 26 is matched with nozzle 22 by means of coaxial round cavity 27.

The water locking means, including a fixing part 40 and movable part rotating relative to fixing part 40, is a tube located axially in the center of cap body 1, and this tube bottom is closed and a cylindric protuberance 42 is disposed inside the bottom, and outlet 44 is disposed on the sidewall of the tube adjacent to the closing bottom. The movable part of water locking means is right angle shape, including two connected tubes, tube 32 in vertical direction and tube 31 in horizontal direction, and tube 32 and tube 31 are molded into one unit. The outer wall of tube 32 is connected to the tube inner wall of fixing part 40 of water locking means by means of liquid-tight fit, and the port of tube 32 is matched with cylindric protuberance 42. Inlet 30 is disposed at the bottom of tube 32 corresponding to outlet 44, and the movable part rotates relative to fixing part 40 pursuant to tube 32 as axis to fulfill butt joint or interleaving of outlet 44 and inlet 30, and thus to fulfill opening or closing of spray means 2. Cavity 38 is disposed inside tube 31, and support bracket 43 supporting atomizing spool 21 is disposed inside cavity 38, and spray means is disposed inside cavity 38 and connected to cavity 38 by means of interference and liquid-tight fit; support bracket 43 is used to support atomizing spool 21. In order to strengthen the liquid-tight effect between the vertical tube 32 of movable part and tube of fixing part 40, an annular groove 41 is disposed on the inner wall of tube of fixing part 40 of water locking means, and an annular protuberance 39 is disposed on the movable part of the said water locking means, which is matched with groove 41 on the inner wall of tube of fixing part 40.

On-off position means of water locking means is disposed on the end face of cap body 1, and the position means includes position blocks 33 and 36 respectively fixed on 0° and 90° positions of end face of cap body 1, respectively positioning opening and closing of water locking means, and cambered surfaces 34 and 37 are disposed on the position blocks in the rotating direction of the tube in the vertical direction to match with the tube. A limiting protuberance 35 is disposed on the cambered surface bottom of the closed position block of the position water locking means corresponding to the other side of the tube in horizontal direction to prevent tube 31 from automatically opening without external force. In addition, due to consideration of hygiene, an auxiliary cap can be added above the cap body, which is flexibly connected with the cap body by means of flexible connecting piece; or a small cap body can be added at one end of spray aperture of the nozzle to strengthen water locking effect and hygiene.

Embodiment 2

Figure 8:
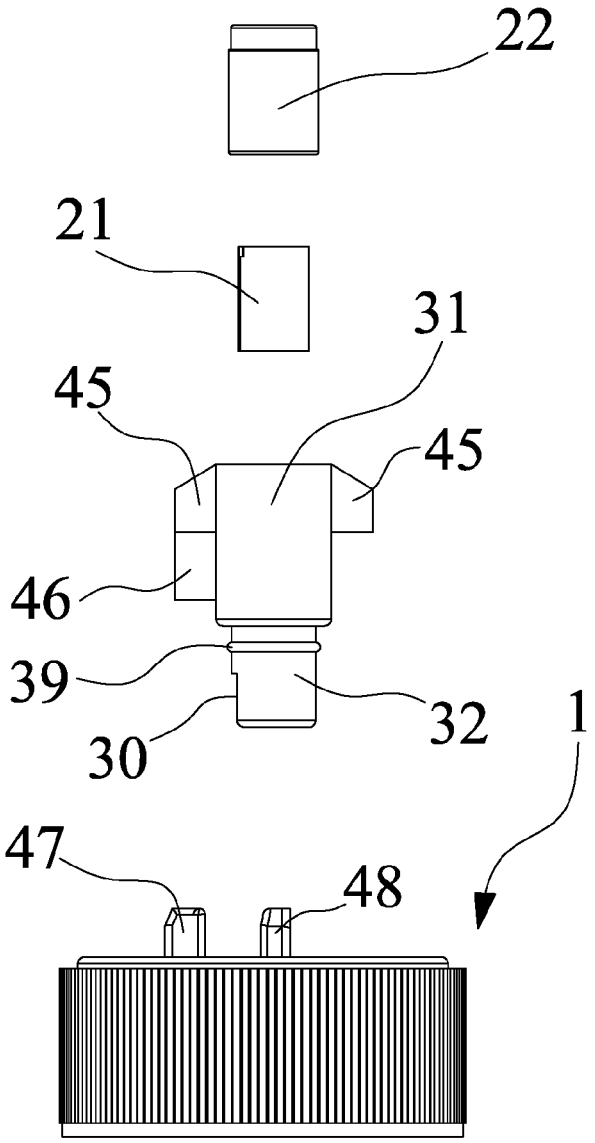
FIG. 8 is the exploded view for the embodiment 2 of the cap of spray mineral water bottle in this invention.
Figure 9:
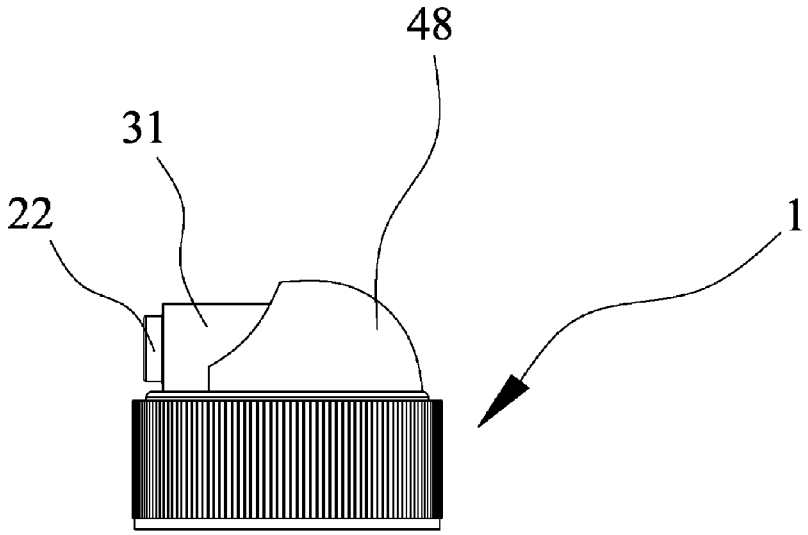
FIG. 9 is the structural schematic view for the embodiment 3 for the cap of spray mineral water bottle in this invention.
Figure 10:
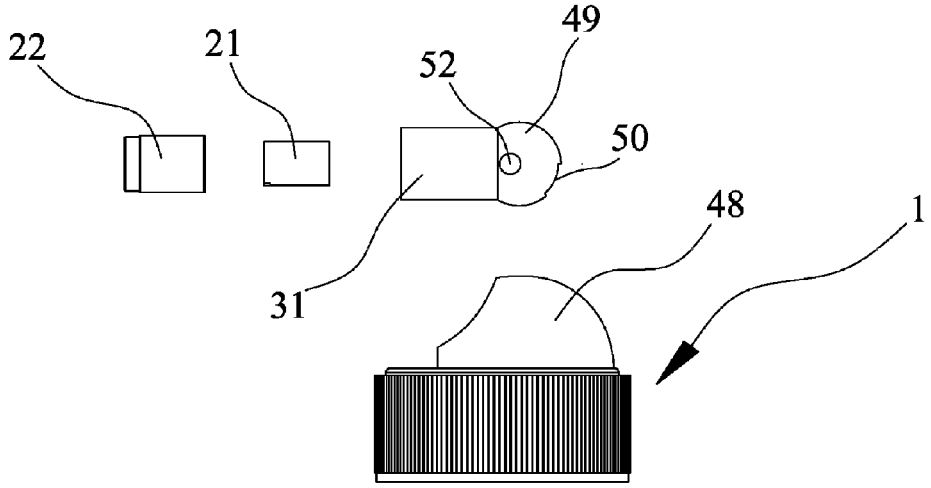
FIG. 10 is the exploded and extended view of FIG. 9.
Figure 11:
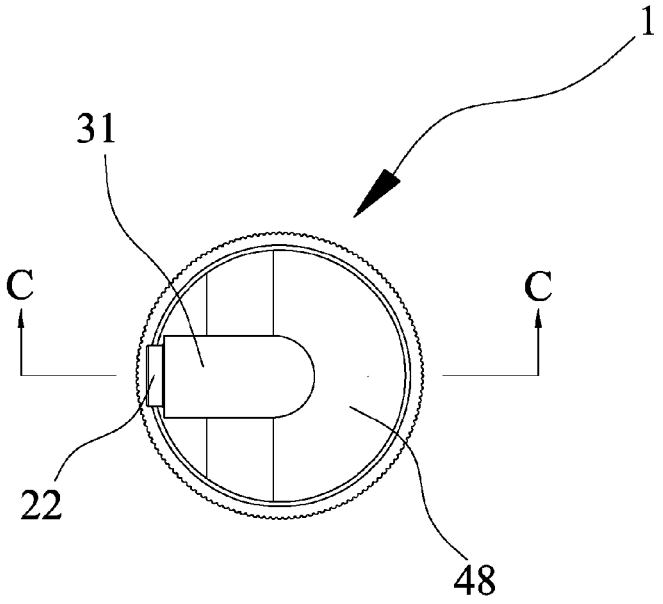
FIG. 11 is the top view of FIG. 9.
Figure 12:
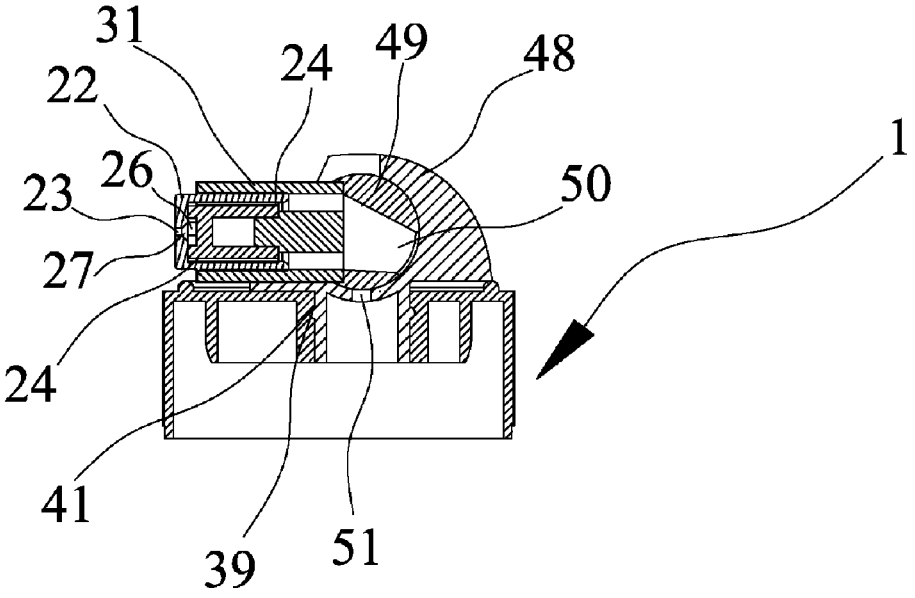
FIG. 12 is the C-C sectional view of FIG. 11.
Figure 13:
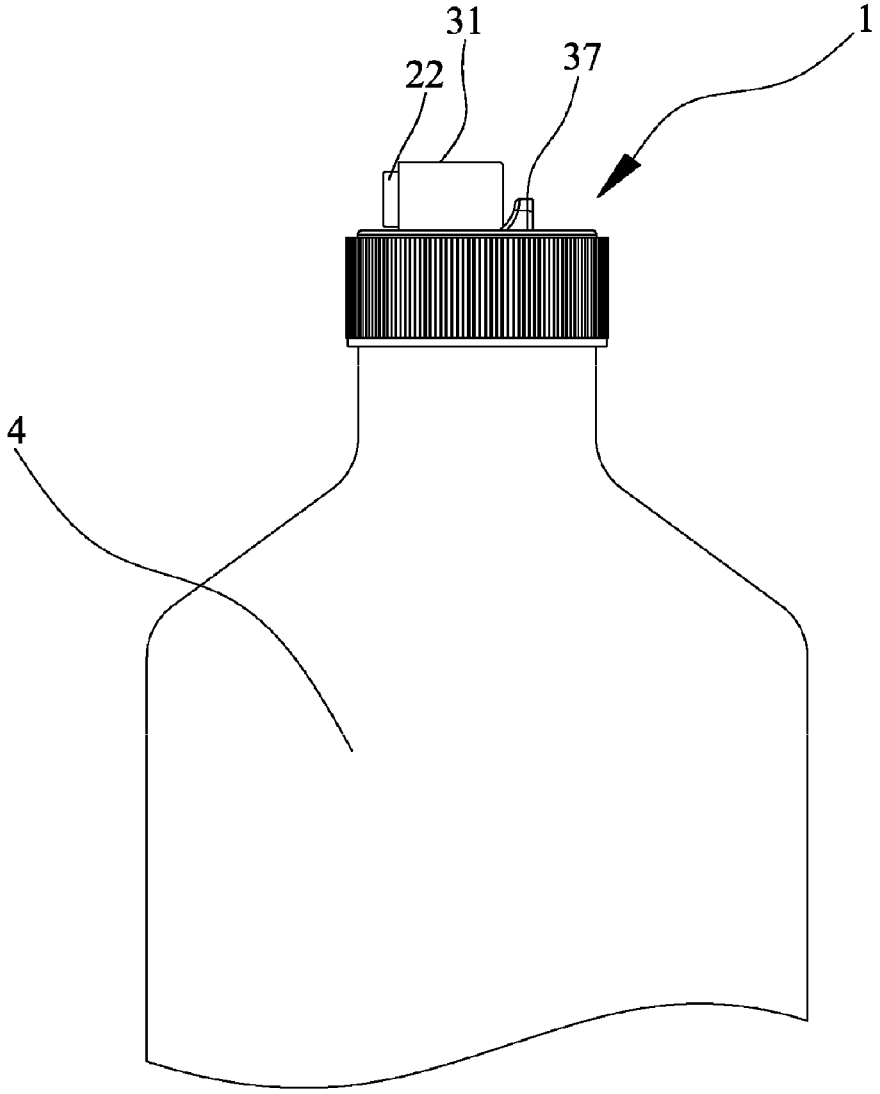
FIG. 13 is the structural schematic view of the multifunctional spray mineral water bottle in this invention.
Figure 14:
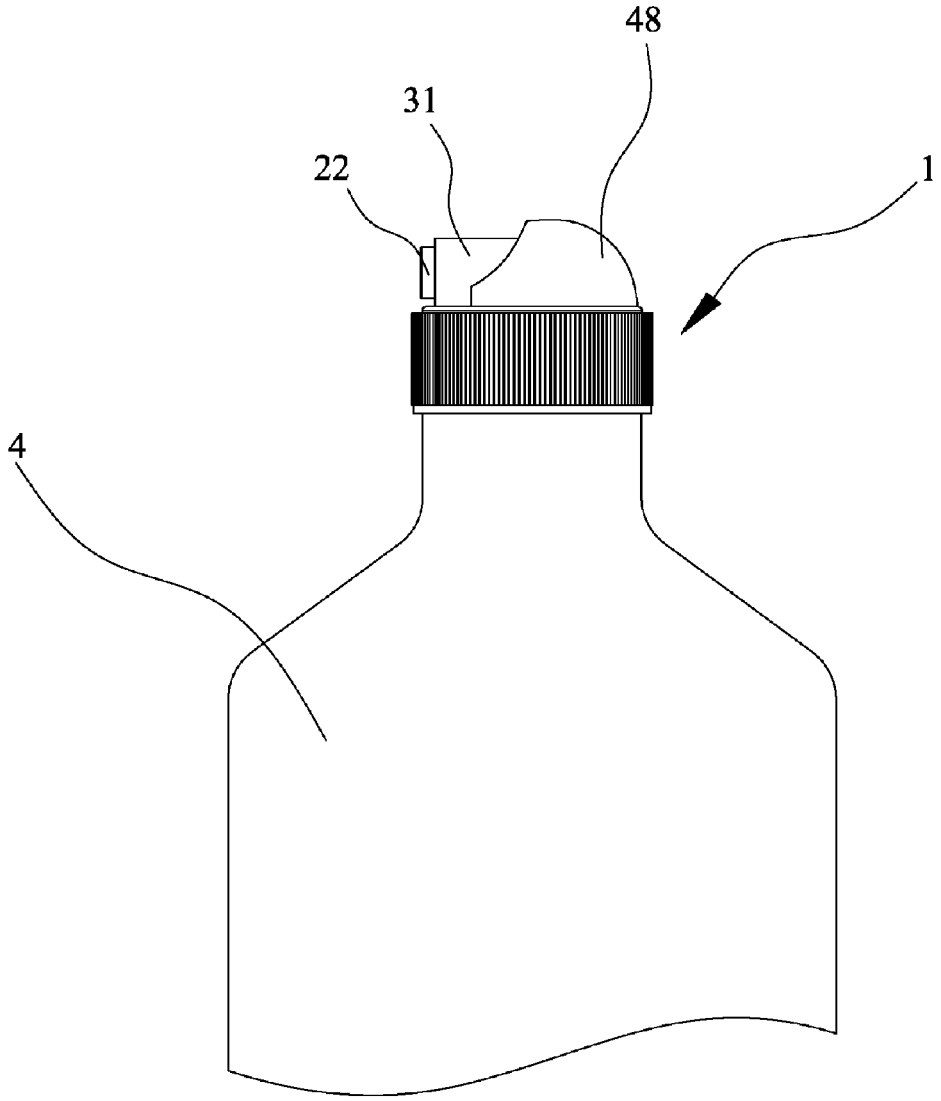
FIG. 14 is the structural schematic view for the embodiment 2 of multifunctional spray mineral water bottle in this invention.

As shown in FIG. 8, in comparison with the right angle shaped movable part of water locking means in the embodiment 1, the movable part of water locking means in embodiment 2 is straight line shape, including movable part tube 31 and tube 32, wherein tube 32 is sleeve jointed inside the fixing part 40 tube in the embodiment 1, annular protuberance 39 is matched with annular groove 41, the bottom port of tube 32 is matched with cylindric protuberance 42 at the bottom of the fixing part tube, the movable part rotates relative to the fixing part back and forth to fulfill the butt joint or interleaving between inlet 30 and outlet 44, thus achieving the opening and closing of the spray means. A cavity is disposed inside tube 31, atomizing spool 21 is sleeve jointed to the cavity of the nozzle to form spray means 2, and the spray means is sleeve jointed to the cavity of tube 31. To facilitate rotation of the movable part of water locking means, rotating handles 45 are disposed at both sides of upper end of tube 31. On-off position means is disposed between the middle of tube 31 and end face of cap body 1, and this position means includes position blocks 47 and 48 respectively fixed on 0° and 90° positions of end face of cap body and limiting stopper 46 fixed on the corresponding position of the movable part.

Embodiment 3

The embodiment 3 is shown in FIG. 9 to FIG. 12, a cap of spray mineral water bottle, including cap body 1, spray means and water locking means, wherein the spray means includes atomizing spool 21 and nozzle 22, and two water channels 24 are disposed on the outer wall of atomizing spool 21, and the number of water channels can be increased pursuant to the water volume, atomizing channel 26 corresponding to water channel 24 is disposed on the end face of atomizing spool 21 corresponding to water channel 24, and water channel 24 and atomizing channel 26 are connected by means of two connecting channels. The cavity is disposed in nozzle 22 to hold atomizing spool 21, and spray aperture 23 is disposed on the end face of one end of nozzle 22; atomizing spool 21 is matched with cavity of nozzle 22 by means of interference fit, and atomizing aperture 26 is matched with nozzle 22 by means of coaxial round cavity 27.

The fixing part of water locking means is fixed on the end face of cap body 1, its bottom tube is sleeve jointed to the tube of cap body 1, and annular protuberance 39 is matched with annular groove 41. The spherical working face is disposed on the end face of bottom tube of the fixing part, and outlet 51 is disposed on the spherical working face; the said movable part of water locking means includes sphere 49 which is matched with spherical working face of fixing part by means of liquid-tight fit, and flexibly connected to the fixing part by means of the rotating axis 52; strip inlet 50 is disposed on the outlet 49 rotating track of the sphere, and when sphere 49 leaves the closing status of water locking means, the butt joint between outlet 51 and inlet 50 is opened; tube 31 is fixed on sphere 49, tube 31 cavity is connected to strip inlet 50, and open-end of the tube is connected to the spray means by means of interference and liquid-tight fit. Position means 48 for opening and closing the movable part is disposed on the fixing part, which allows the movable part to rotate within the specified radian of 90° degrees.

Embodiment 4

A multifunctional spray mineral water bottle is shown in FIG. 13 and FIG. 1 to FIG. 7, including resilient bottle body 4 and cap of spray mineral water bottle. The resilient bottle body and cap of spray mineral water bottle contain cap body 1, spray means 2 and water locking means. Cap body 1 is matched with mineral water bottleneck by means of liquid-tight fit, and an outlet is disposed on the end face of cap body 1. A cap body is matched with mineral water bottleneck by means of liquid-tight fit, and an outlet aperture is disposed on the end face of cap body. Spray means 2 includes atomizing spool 21 and nozzle 22, and two water channels 24 are disposed on the outer wall of atomizing spool 21, the number of water channels can be increased pursuant to the water volume; atomizing channel 26 corresponding to water channel 24 is disposed on the end face of atomizing spool 21 corresponding to water channel 24, water channel 24 and atomizing channel 26 are connected by means of two connecting channels 25. Cavity 28 is disposed in nozzle 22 to hold atomizing spool 21, and spray aperture 23 is disposed on the end face of one end of nozzle 21; atomizing spool 21 is matched with nozzle 22 cavity by means of interference fit, and atomizing aperture 26 is matched with nozzle 22 by means of coaxial round cavity 27.

The water locking means includes fixing part 40 and movable part rotating relative to fixing part 40, where fixing part 40 is a tube located axially in the center of cap body 1, and this tube bottom is closed and cylindric protuberance 42 is disposed inside the bottom, and outlet 44 is disposed on the sidewall adjacent to the closing end of the tube. The movable part of water locking means is right angle shape, including the connected tubes, tube 32 in vertical direction and tube 31 in horizontal direction, and tube 32 and tube 31 are molded into one unit. The outer wall of tube 32 is matched with the inner wall of the tube of fixing part 40 of water locking means by means of liquid-tight fit, and the port of tube 32 is matched with cylindric protuberance 42. Inlet 30 is disposed at the bottom of tube 32 corresponding to outlet 44, the movable part rotates relative to fixing part 40 pursuant to tube 32 as axis, to fulfill butt joint or interleaving between outlet 44 and inlet 30, thus achieving opening or closing of spray means 2. Cavity 38 is disposed inside tube 31, support bracket 43 supporting atomizing spool 21 is disposed inside cavity 38, spray means is disposed in cavity 38 and is matched with cavity 38 by means of interference and liquid-tight fit, and support bracket 43 is used to support atomizing spool 21. To strengthen liquid-tight effect between tube 32 of movable part and fixing part 40 tube, annular groove 41 is disposed on the inner wall of fixing part 40 tube of water locking means, annular protuberance 39 is disposed on the said movable part of water locking means, which is matched with groove 41 on the inner wall of fixing part 40 tube.

An on-off position means of the water locking means is disposed on an end face of the cap body 1, the on-off position means includes position blocks 33 and 36 respectively fixed on the on-off position of 0° and 90° on the end face of the cap body 1, respectively positioning opening and closing of the water locking means, and cambered surfaces 34 and 37 are disposed in the rotating directions of the tube in vertical direction the position blocks to match with the tube. A limiting protuberance 35 is disposed on the cambered surface bottom of the closed position block of the position water locking mews, to prevent the second connection tube 31 from automatically opening without an external force. The second connection tube 31 is rotated to cross over the limiting protuberance 35 so that the water locking means moves from the close position to the open position.

Embodiment 5

A multifunctional spray mineral water bottle is shown in FIG. 14 and FIG. 9 to FIG. 12, including resilient bottle body 4 and cap of spray mineral water bottle. The structure of the cap of spray mineral water bottle is described in Embodiment 3, so it will not be repeated here.

Embodiment 6

Figure 15:
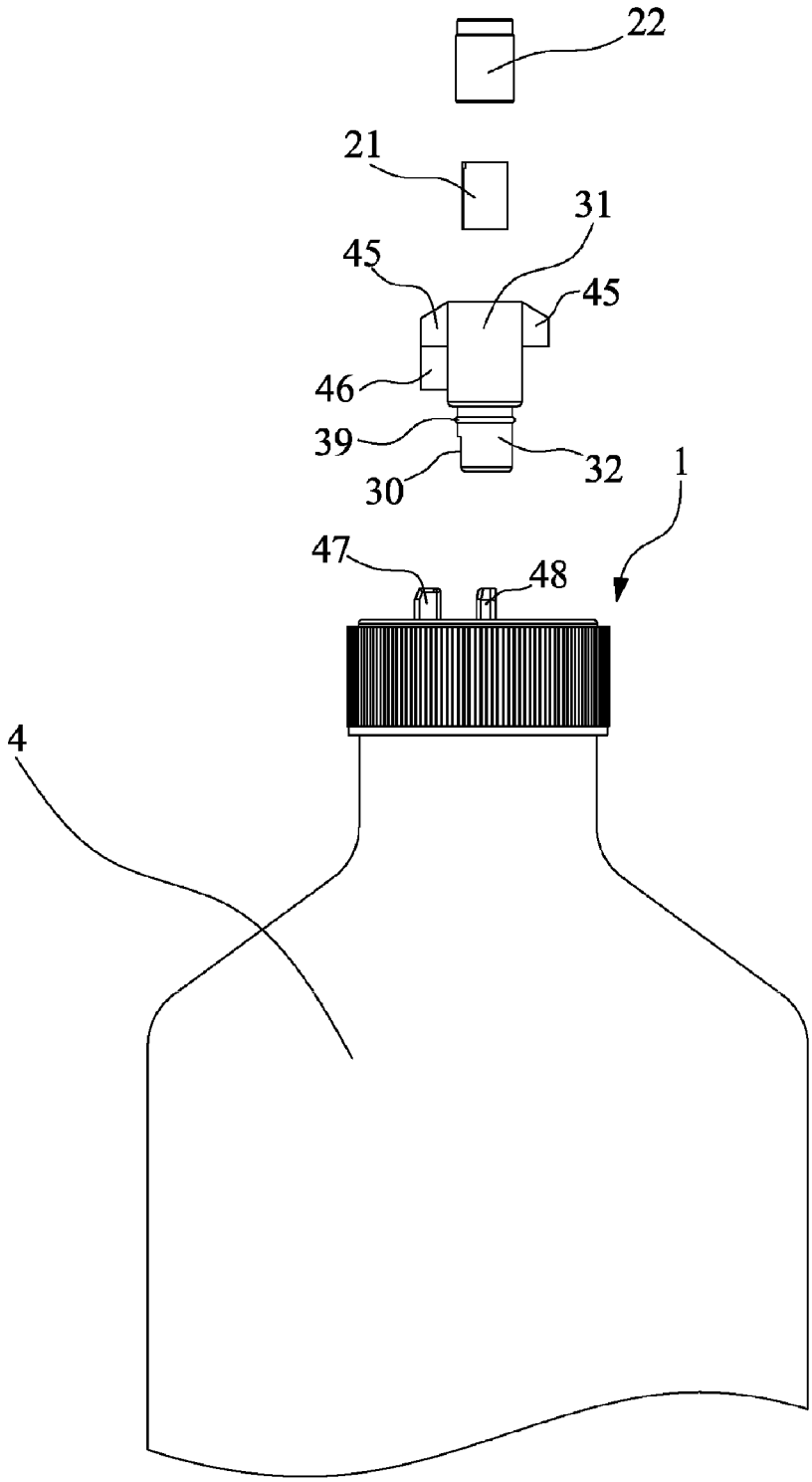
FIG. 15 is the structural schematic view for the embodiment 3 of multifunctional spray mineral water bottle in this invention.

A multifunctional spray mineral water bottle is shown in FIG. 15 and FIG. 8, including resilient bottle body 4 and cap of spray mineral water bottle. The structure of the cap of spray mineral water bottle is described in Embodiment 2, so it will not be repeated here.

This cap of spray mineral water is used with resilient mineral water bottle body to form a multifunctional spray mineral water bottle, which can ensure normal drinking of mineral water as well as carry out spray drinking of water by means of squeezing the bottle body to transform bottle body and increase the pressure inside, thus making water to enter inlet from the outlet of water locking means on the cap, and to enter the atomizing channel through the water channel, finally to be sprayed from the spray aperture. Furthermore, in the open air or in the dusty and hot environment, you can place the mineral water bottle upside down, put the nozzle to face your body or surrounding, and squeeze the bottle body to spray, thus reducing surrounding temperature, as well as subsiding dust by combining dust and spray to make you feel cool, fresh and comfortable. This invention features in simple structure and strong practicability, so it has promising market prospect.

The foregoing descriptions of the embodiments and their accompanying drawings of the invention are intended to illustrate and not to limit this invention. Various changes and modifications may be made to the embodiments without departing from the spirit of the invention. Therefore, the scope of the invention is to be limited only by the appended claims.

What is claimed is:

1. A cap of a spray mineral water bottle, comprising:

a cap body connected with a bottleneck of the spray mineral water bottle by means of liquid-tight fit, and the cap body defining an outlet aperture on an end face of the cap body;

a spray means comprising an atomizing spool and a nozzle, wherein two water channels are defined on an outer wall of the atomizing spool, and atomizing channels are defined on an end face of atomizing spool and corresponds to the water channels; and wherein a cavity is defined in the nozzle to hold the atomizing spool, and a spray aperture is defined on an end face of the nozzle; and wherein the atomizing spool is secured in the cavity of the nozzle by assembly stress, and the atomizing channels communicate with the spray aperture of the nozzle; and a water locking means comprising a fixing part and a movable part capable of rotating relative to the fixing part, and wherein the fixing part of the water locking means comprises a tube located axially in a center of the cap body, and a bottom of the tube is sealed and an outlet of the fixing part is defined on a sidewall of the tube adjacent to the bottom of the tube; a bottom of the movable part of the water locking means sleeves in the tube and is capable of rotating relative to the tube, and an inlet of the movable part is defined on a bottom of the movable part and corresponds to the outlet of the fixing part; and wherein the movable part rotates relative to the fixing part, when the outlet of the fixing part communicates with the inlet of the movable part the spray means opens to spray water, and when the outlet of the fixing part is staggered with the inlet of the movable part, the spray means closes;

wherein the movable part of the water locking means is in a shape of a right angle, and comprises a first connection tube in a vertical direction and a second connection tube in a horizontal direction, and wherein the first connection tube is integrated with the second connection tube; the first connection tube is connected to the fixing part of the water locking means by means of liquid-tight fit, the movable part rotates relative to the fixing part around an axis of the first connection tube; and wherein a receiving space of the movable part is defined inside the second connection tube, and the spray means is secured in the receiving space by assembly stress; and wherein the second connection tube comprises a support bracket disposed inside the receiving space to support the atomizing spool;

wherein an on-off position means is located on an end surface of the cap body, and the on-off position means comprises a pair of position blocks respectively fixing the spray means on 0° and 90° positions, the pair of positioning blocks are configured to fix the water locking means in an open position and in a close position, respectively, and wherein each positioning block comprises a cambered surface matched with the second connection tube, wherein a limiting protuberance is disposed on one side of a bottom of the cambered surface of one of the positioning blocks corresponding to another side of the second connection tube, and the positioning block fixes the water locking means in the close position, and wherein the limiting protuberance is configured to prevent the second connection tube from opening automatically without an external force; and wherein the second connection tube is rotated to cross over the limiting protuberance so that the water locking means moves from the close position to the open position.

2. The cap of the spray mineral water bottle of claim 1, wherein an annular groove is defined on an inner wall of the tube of the fixing part of water locking means, and the movable part of water locking means comprises an annular protuberance engaging with the annular groove on the inner wall of the tube of the fixing part.

3. The cap of the spray mineral water bottle of claim 1, wherein a cylindric protuberance is defined in an interior side of an end face of the bottom of the fixing part of the water locking means, and wherein the cylindric protuberance engages with the bottom of the movable part of the mater locking means.

4. A multifunctional spray mineral water bottle comprising a resilient bottle body and a cap, the cap comprising:

a cap body connected with a bottleneck of the spray mineral water bottle by means of liquid-tight fit, and the cap body defining an outlet aperture on an end face of the cap body;

a spray means comprising an atomizing spool and a nozzle, wherein two water channels are defined on an outer wall of the atomizing spool, and atomizing channels are defined on an end face of atomizing spool and corresponds to the water channels; and wherein a cavity is defined in the nozzle to hold the atomizing spool, and a spray aperture is defined on an end face of the nozzle; and wherein the atomizing spool is secured in the cavity of the nozzle by assembly stress, and the atomizing channels communicate with the spray aperture of the nozzle; and a water locking means comprising a fixing part and a movable part capable of rotating relative to the fixing part, and wherein the fixing part of the water locking means comprises a tube located axially in a center of the cap body, and a bottom of the tube is sealed and an outlet of the fixing part is defined on a sidewall of tube adjacent to the bottom of the tube; a bottom of the movable part of the water locking means sleeves in the tube and is capable of rotating relative to the tube, and an inlet of the movable part is defined on a bottom of the movable part and corresponds to the outlet of the fixing part; and wherein the movable part rotates relative to the fixing part, when the outlet of the part communicates with the inlet of the movable part, the spray means opens to spray water, and when the outlet of the fixing part is staggered with the inlet of the movable part, the spray means closes;

wherein the movable part of the water locking means is in a shape of a right angle, and comprises a first connection tube in a vertical direction and a second connection tube in a horizontal direction, and wherein the first connection tube is integrated with the second connection tube; the first connection tube is connected to the fixing part of the water locking means by means of liquid-tight fit, the movable part rotates relative to the fixing part around an axis of the first connection tube; and wherein a receiving space of the movable part is defined inside the second connection tube, and the spray means is secured in the receiving space by assembly stress; and wherein the section connection tube comprises a support bracket disposed inside the receiving space to support the atomizing spool;

wherein an on-off position means of the water locking means is located at the end face of the cap body, and the on-off position means comprises a pair of position blocks respectively fixed on 0° and 90° positions of the end face of the cap body, and the pair of position blocks are configured to fix the water locking means in an open position and in a close position, respectively, and wherein each positioning block comprises a cambered surface matched with the first connection tube along a rotating direction of the first connection tube;

wherein a limiting protuberance is disposed on one side of a bottom of the cambered surface of one of the positioning blocks corresponding to another side of the second connection tube, and the positioning block fixes the water locking means in the close position, and wherein the limiting protuberance is configured to prevent the second connection tube from opening automatically without en external force; and wherein the second connection tube is rotated to cross over the limiting protuberance so the water locking means moves from the close position to the open position.

5. The multifunctional spray mineral water bottle of claim 4, wherein an annular groove is defined on an inner wall of the tube of the fixing part of water looking means, and the movable part of water locking means comprises an annular protuberance engaging with the annular groove on the inner wall of the tube of the fixing part.

6. The multifunctional spray mineral water bottle of claim 4, wherein a cylindric protuberance is defined in an interior side of an end face of the bottom of the fixing part of the water locking means, and wherein the cylindric protuberance engages with the bottom of the movable part of the water locking means.

7. A cap of a spray mineral water bottle, comprising:

a cap body connected with a bottleneck of the spray mineral water bottle;

a spray means; and a water locking means comprising a fixing part and a movable part capable of rotating relative to the fixing part, and wherein die fixing part of the water locking means comprises a tube located axially in a center of the cap body, and a bottom of the tube is sealed and an outlet of the fixing part is defined on a sidewall of the tube adjacent to the bottom of the tube; a bottom of the movable part of the water locking means sleeves in the tube and is capable of rotating relative to the tube, and an inlet of the movable is defined on a bottom of the movable part and corresponds to the outlet of the fixing part; and wherein the movable part rotates relative to the fixing part, when the outlet of the fixing part communicates with the inlet of the movable part, the spray means opens to spray water, and when the outlet of the fixing part is staggered with the inlet of the movable part, the spray means closes;

wherein the movable part of the water locking means is in a shape of a right angle, and comprises a first connection tube in a vertical direction and a second connection tube in a horizontal direction, and wherein the first connection tube is integrated with the second connection tube; the first connection tube is connected to the fixing part of the water locking means by means of liquid-tight fit, the movable part rotates relative to the fixing part around an axis of the first connection tube; and wherein a receiving space of the movable part is defined inside the second connection tube, and the spray means is secured in the receiving space by assembly stress;

wherein an on-off position means is located on an end surface of the cap body, and the on-off position means comprises a pair of position blocks respectively-fixing the spray means on 0° and 90° positions, the pair of positioning blocks are configured to fix the water locking means in an open position and in a close position, respectively, and wherein each positioning block comprises a cambered surface matched with the second connection tube;

wherein a limiting protuberance is disposed on one side of a bottom of the cambered surface of one of the positioning blocks, and the one of the positioning blocks corresponds to the close position of the water locking means, and the limiting protuberance fixes the water locking means in the close position to prevent the second connection tube from opening automatically without an external force; and wherein the second connection tube is rotated to cross over the limiting protuberance so that the water locking means moves from the close position to the open position.

8. The cap of the spray mineral water bottle of claim 7, wherein the spray means comprising an atomizing spool and a nozzle, wherein a cavity is defined in the nozzle to hold the atomizing spool; and wherein the second connection tube comprises a support bracket disposed inside the receiving space to support the atomizing spool.

* * * * *